US009698540B2

(12) United States Patent
Xing et al.

(10) Patent No.: US 9,698,540 B2
(45) Date of Patent: Jul. 4, 2017

(54) CABLE CONNECTOR ASSEMBLY HAVING INTERNAL METALLIC SHIELD

(71) Applicant: FOXCONN INTERCONNECT TECHNOLOGY LIMITED, Grand Cayman (KY)

(72) Inventors: Da-Wei Xing, Kunshan (CN); Jun Chen, Kunshan (CN); Jerry Wu, Irvine, CA (US)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/011,670

(22) Filed: Feb. 1, 2016

(65) Prior Publication Data

US 2016/0233620 A1 Aug. 11, 2016

(30) Foreign Application Priority Data

Feb. 11, 2015 (CN) ..... 2015 2 0095859 U

(51) Int. Cl.

*H01R 13/648* (2006.01)
*H01R 13/6593* (2011.01)
*H01R 24/60* (2011.01)
*H01R 107/00* (2006.01)

(52) U.S. Cl.

CPC ..... *H01R 13/6593* (2013.01); *H01R 24/60* (2013.01); *H01R 2107/00* (2013.01)

(58) Field of Classification Search

CPC ..... H01R 13/6581; H01R 13/6594; H01R 13/6597

USPC ..... 439/607.27, 607.01, 607.35, 607.46, 439/607.5

See application file for complete search history.

(56) References Cited

U.S. PATENT DOCUMENTS 5,244,415 A * 9/1993 Marsilio ..... H01R 9/032 439/456
6,203,333 B1 * 3/2001 Medina ..... H01R 13/6658 439/465
6,935,896 B1 * 8/2005 Tsai ..... H01R 13/506 439/541.5
7,485,013 B2 * 2/2009 Kuo ..... H01R 9/03 439/731
8,784,123 B1 7/2014 Leiba et al.
8,794,981 B1 8/2014 Rodriguez et al.
8,821,181 B1 9/2014 Lam et al.
8,888,510 B2 * 11/2014 Webb ..... H01R 23/70 439/607.41

(Continued)

*Primary Examiner* — Abdullah Riyami
*Assistant Examiner* — Nader Alhawamdeh
(74) *Attorney, Agent, or Firm* — Wei Te Chung; Ming Chieh Chang

(57) ABSTRACT

A cable connector assembly includes: a printed circuit board (PCB) having a front end, a rear end, and an intermediate portion; a cable electrically connected to the rear end of the PCB; an inner metal member disposed about the intermediate portion of the PCB; an insulating member holding the inner metal member in position relative to the PCB; a metallic shield disposed around the insulating member; a front metal casing engaging the metallic shield; a rear metal casing surrounding a front of the cable and engaging the front metal casing; and an outer over-mold surrounding the front and rear metal casings.

17 Claims, 9 Drawing Sheets

(56) References Cited

U.S. PATENT DOCUMENTS 8,968,031 B2 * 3/2015 Simmel ..... H01R 13/659 439/108
9,028,269 B2 * 5/2015 Hsu ..... H01R 13/518 439/357
9,385,472 B2 * 7/2016 Yen ..... H01R 13/6275
9,385,483 B2 * 7/2016 Wu ..... H01R 13/6593
2006/0040554 A1 * 2/2006 Liu ..... H01R 13/6585 439/607.01
2006/0121783 A1 * 6/2006 Wu ..... H01R 9/032 439/607.41
2008/0050951 A1 * 2/2008 Wu ..... H01R 13/2442 439/108
2008/0132116 A1 * 6/2008 Wu ..... H01R 27/00 439/607.17
2009/0197459 A1 * 8/2009 Yu ..... H01R 4/027 439/497
2009/0203266 A1 * 8/2009 Chuang ..... H01R 13/6666 439/701
2010/0062653 A1 * 3/2010 Mao ..... H01R 12/712 439/660
2010/0068934 A1 * 3/2010 Li ..... H01R 13/627 439/607.55
2010/0151732 A1 * 6/2010 Xu ..... H01R 13/506 439/607.45
2010/0210142 A1 * 8/2010 McGrath ..... H01R 12/594 439/620.22
2011/0195609 A1 * 8/2011 Su ..... H01R 4/2433 439/660
2011/0256756 A1 * 10/2011 Lu ..... H01B 7/0892 439/449
2011/0281465 A1 * 11/2011 Hou ..... H01R 13/6581 439/607.55
2011/0300749 A1 * 12/2011 Sytsma ..... H01R 13/65802 439/607.01
2012/0064758 A1 * 3/2012 Grice ..... H01R 13/641 439/490
2012/0164886 A1 * 6/2012 Ko ..... H01R 13/6658 439/626
2013/0178102 A1 * 7/2013 Wu ..... H01R 23/005 439/620.04
2014/0065884 A1 * 3/2014 Wu ..... H01R 12/598 439/626
2014/0073185 A1 3/2014 Siahaan et al.
2014/0073186 A1 * 3/2014 Webb ..... H01R 23/70 439/607.58
2014/0193122 A1 * 7/2014 Wu ..... G02B 6/428 385/89
2014/0206209 A1 7/2014 Kamei et al.
2015/0044911 A1 * 2/2015 Wu ..... H01R 43/20 439/620.22
2015/0162684 A1 6/2015 Amini et al.
2015/0171562 A1 6/2015 Gao et al.
2015/0229077 A1 8/2015 Little et al.
2015/0288107 A1 * 10/2015 Wu ..... H01R 13/6593 439/357
2015/0311645 A1 10/2015 Chang

* cited by examiner

CABLE CONNECTOR ASSEMBLY HAVING INTERNAL METALLIC SHIELD

BACKGROUND OF THE INVENTION

1. Field of the Invention

The present invention relates generally to a cable connector assembly having an internal printed circuit board (PCB), an internal metallic shield, a front and rear metal casings, and an outer over-mold.

2. Description of Related Arts

U.S. Patent Application Publication No. 2015/0171562 discloses a connector receptacle and a mating connector insert (or connector plug, or cable connector). The connector receptacle includes a tongue carrying contacts or pads and a shield surrounding the tongue. The connector insert may include a shield located around an insulative housing and plural contacts. A leading edge of the shield may be folded back into an opening of the connector insert to form one or more contacts.

U.S. Patent Application Publication No. 2014/0206209 discloses a reversible Universal Serial Bus (USB) plug connector including a tongue, a support structure from which the tongue extends, and a base that may be attached over metallic shield and cable. A shell may be assembled with the base and extend longitudinally away therefrom. The support structure may be overloaded in position to support and provide increased deletion flexibility to the tongue. The tongue may be a PCB or may be made from one or more of a variety of dielectric materials.

A cable connector assembly having an internal metallic shield is desired.

SUMMARY OF THE INVENTION

An object of the present invention is to provide a cable connector assembly that is easy to manufacture and reliable in structure.

To achieve the above-mentioned object, a cable connector assembly includes: a printed circuit board (PCB) having a front end, a rear end, and an intermediate portion; a cable electrically connected to the rear end of the PCB; an inner metal member disposed about the intermediate portion of the PCB; an insulating member holding the inner metal member in position relative to the PCB; a metallic shield disposed around the insulating member; a front metal casing engaging the metallic shield; a rear metal casing surrounding a front of the cable and engaging the front metal casing; and an outer over-mold surrounding the front and rear metal casings.

DETAILED DESCRIPTION OF THE PREFERRED EMBODIMENT

Figure 1:
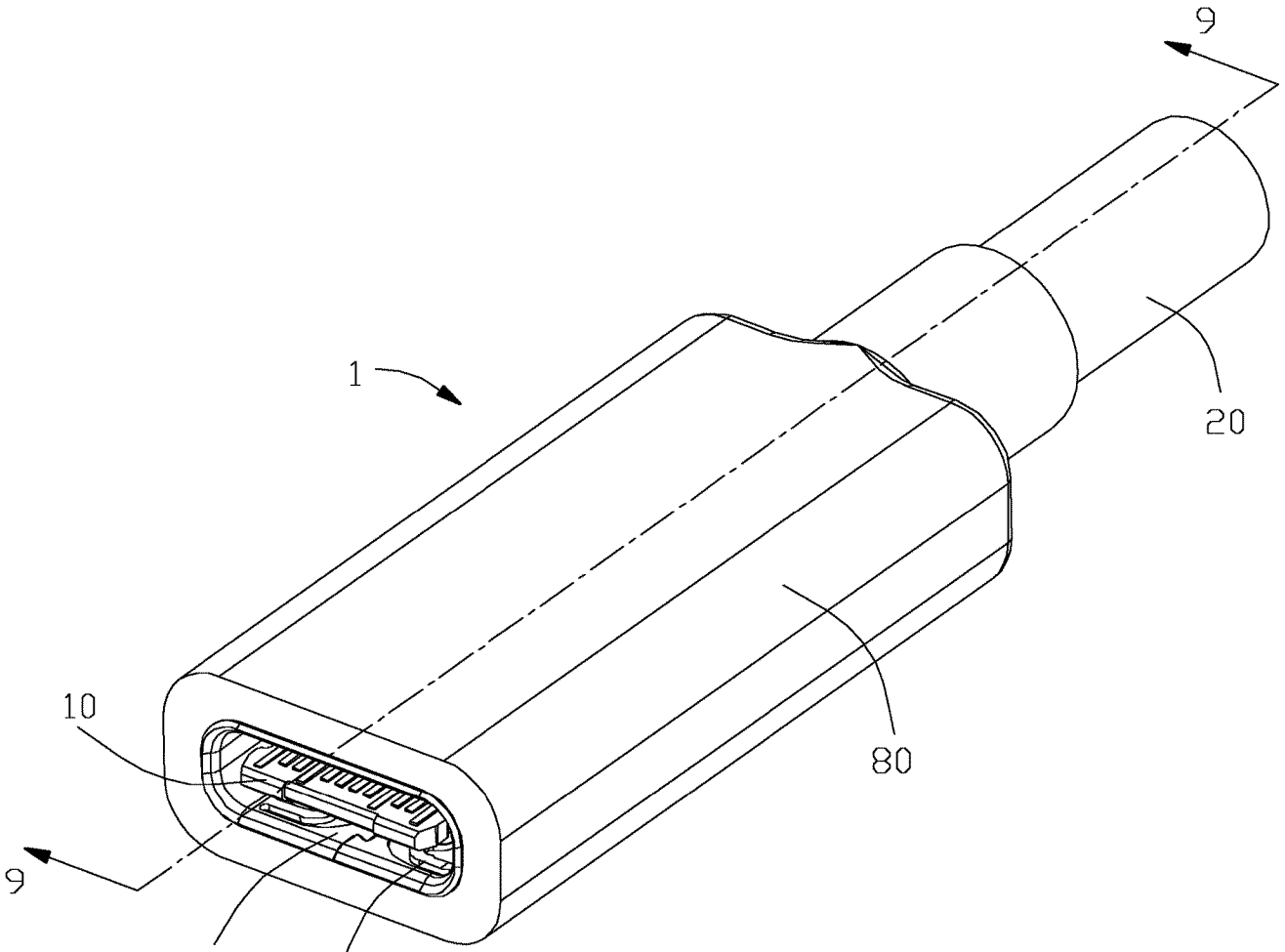
FIG. 1 is a perspective view of a cable connector assembly in accordance with the present invention.
Figure 2:
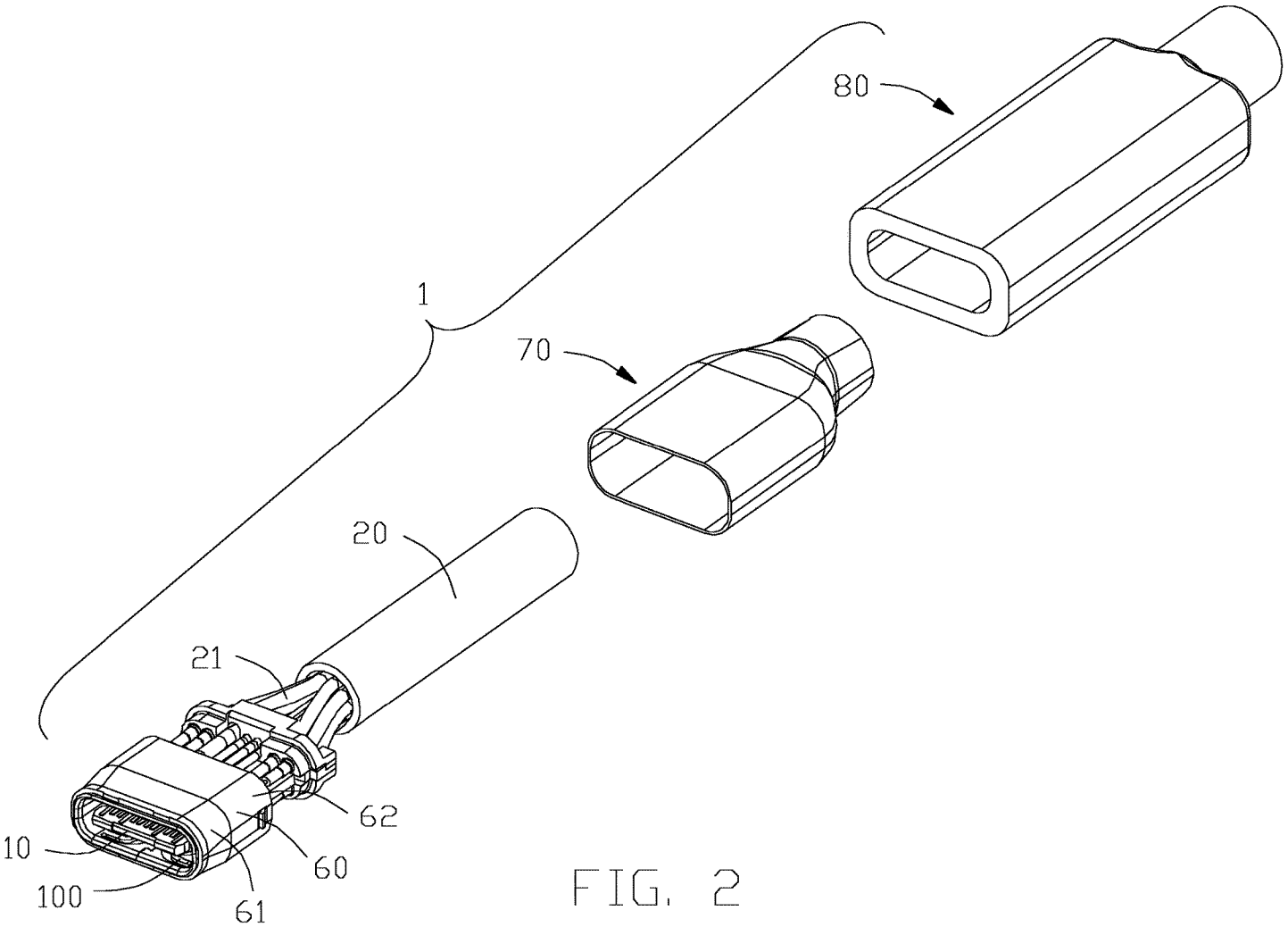
FIG. 2 is a partially exploded view of the cable connector assembly in FIG. 1.
Figure 3:
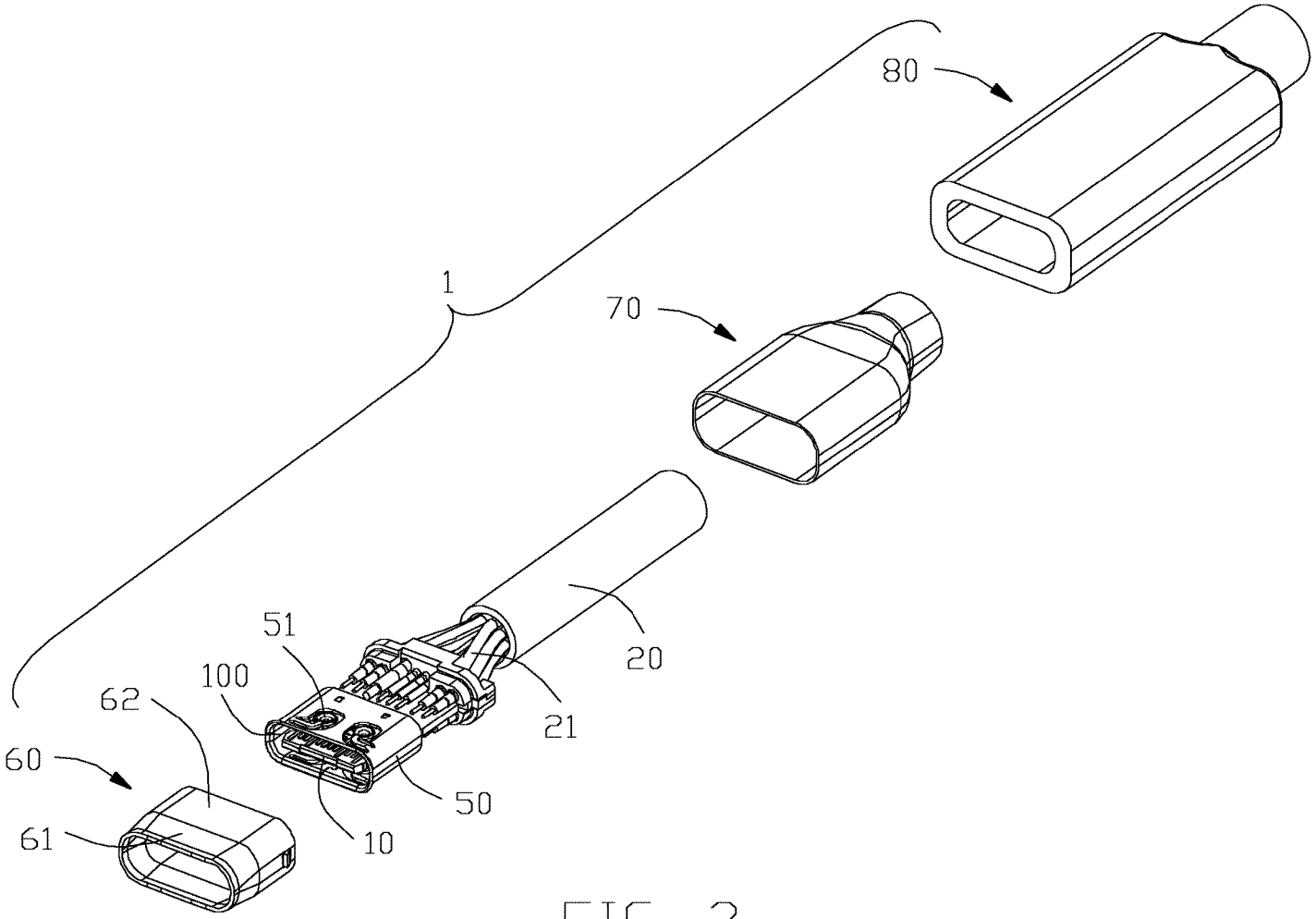
FIG. 3 is a further partially exploded view of the cable connector assembly in FIG. 2.
Figure 4:
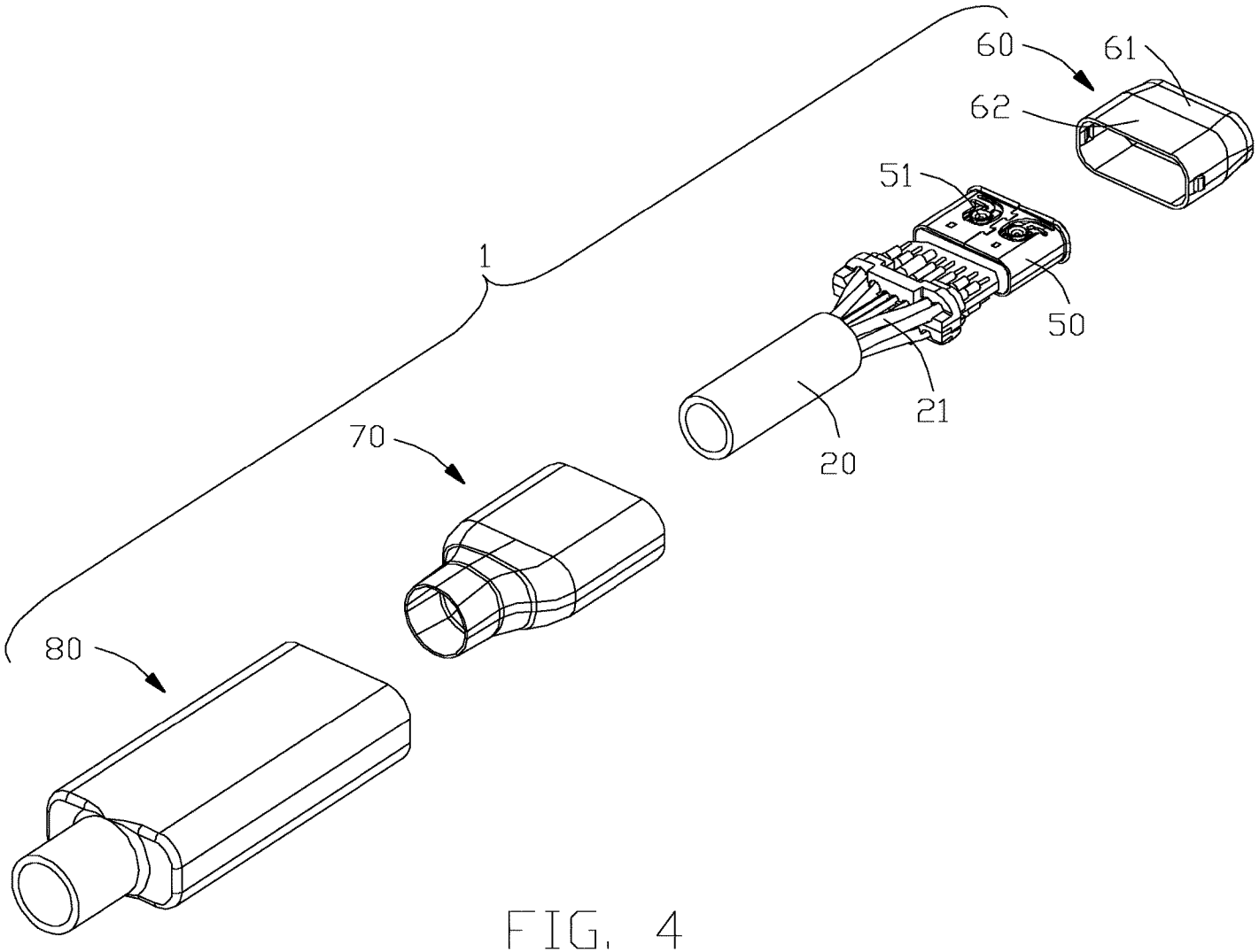
FIG. 4 is a view similar to FIG. 3 but from a different perspective.
Figure 5:
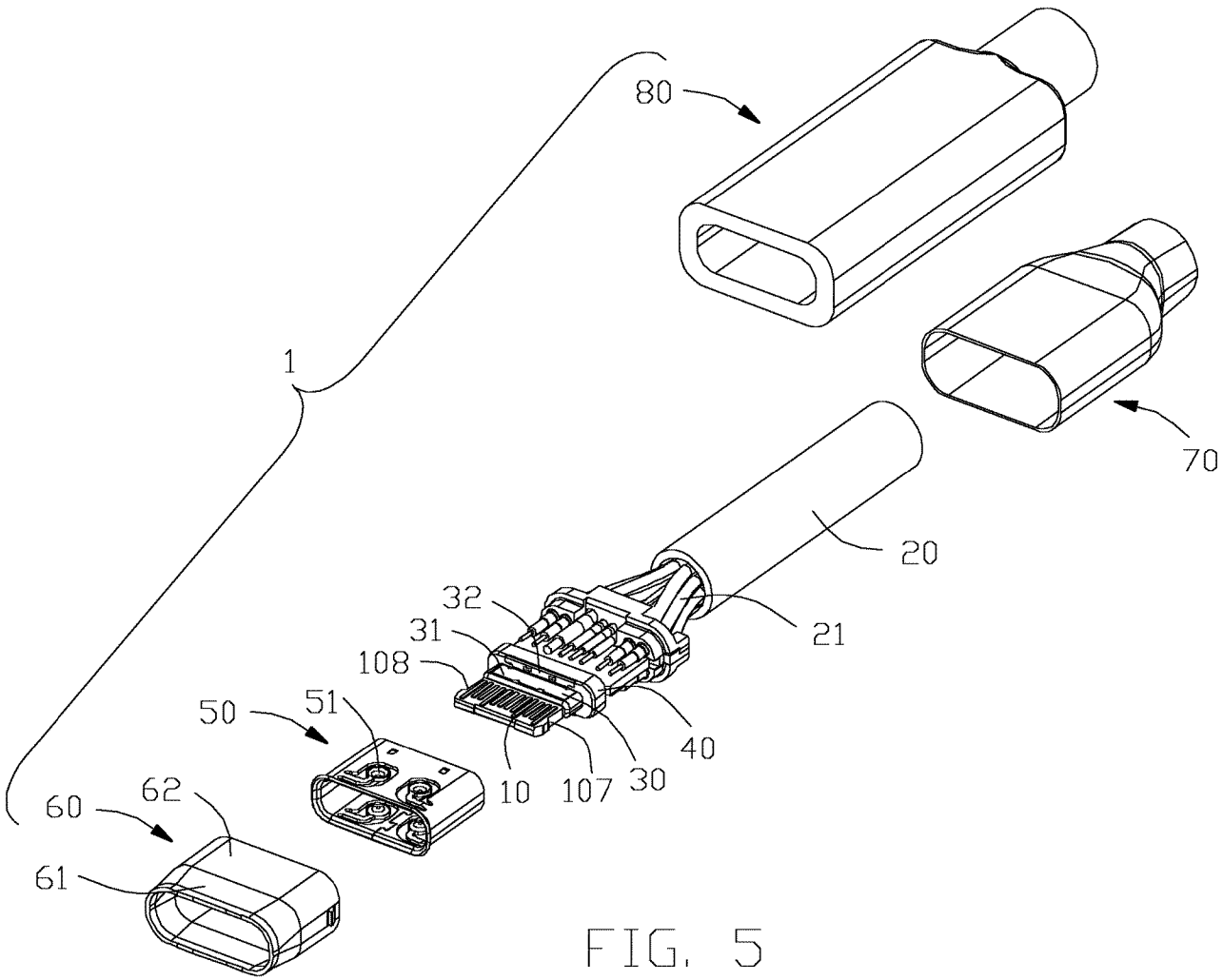
FIG. 5 is a further partially exploded view of the cable connector assembly in FIG. 3.
Figure 6:
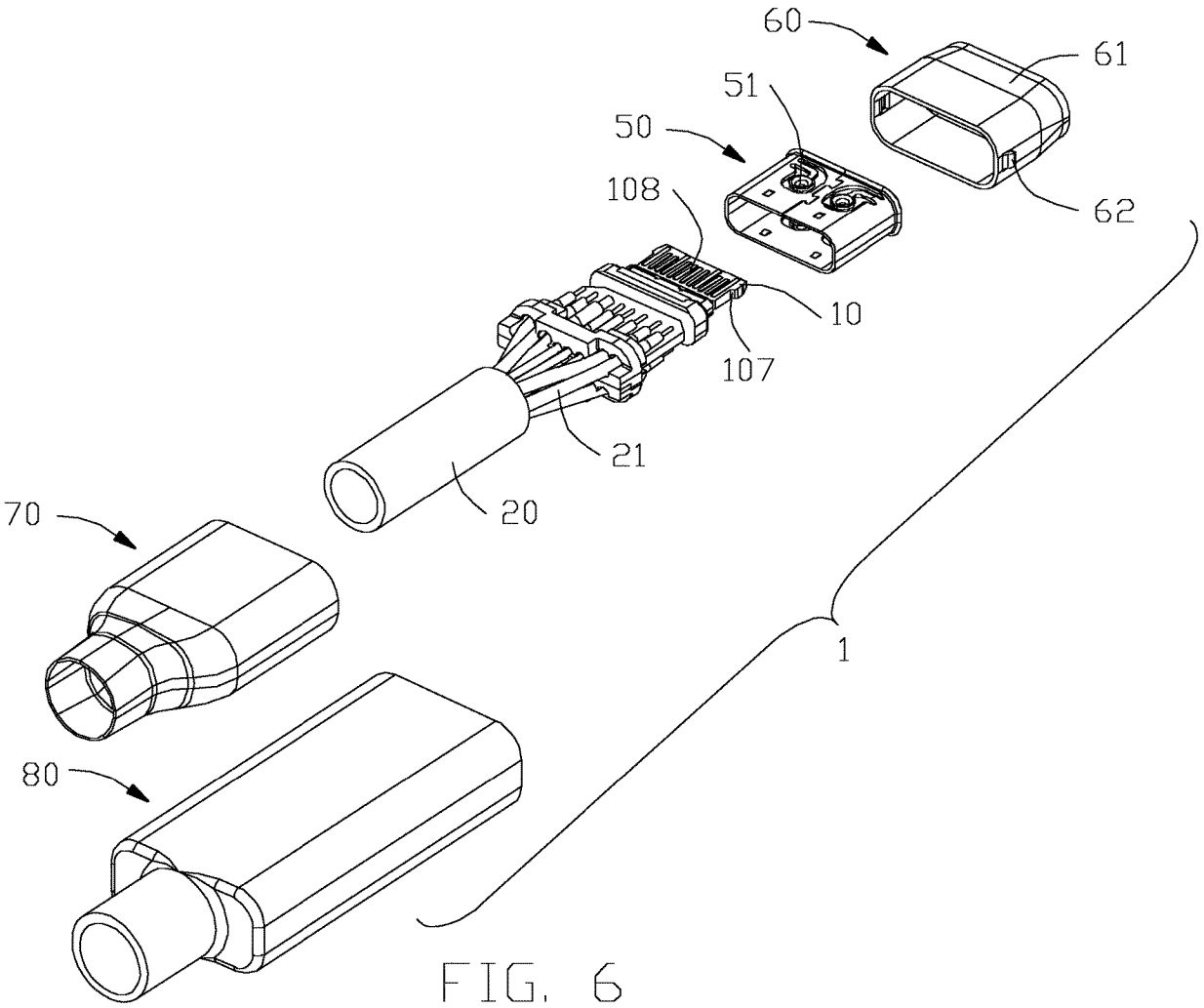
FIG. 6 is a view similar to FIG. 5 but from a different perspective.
Figure 7:
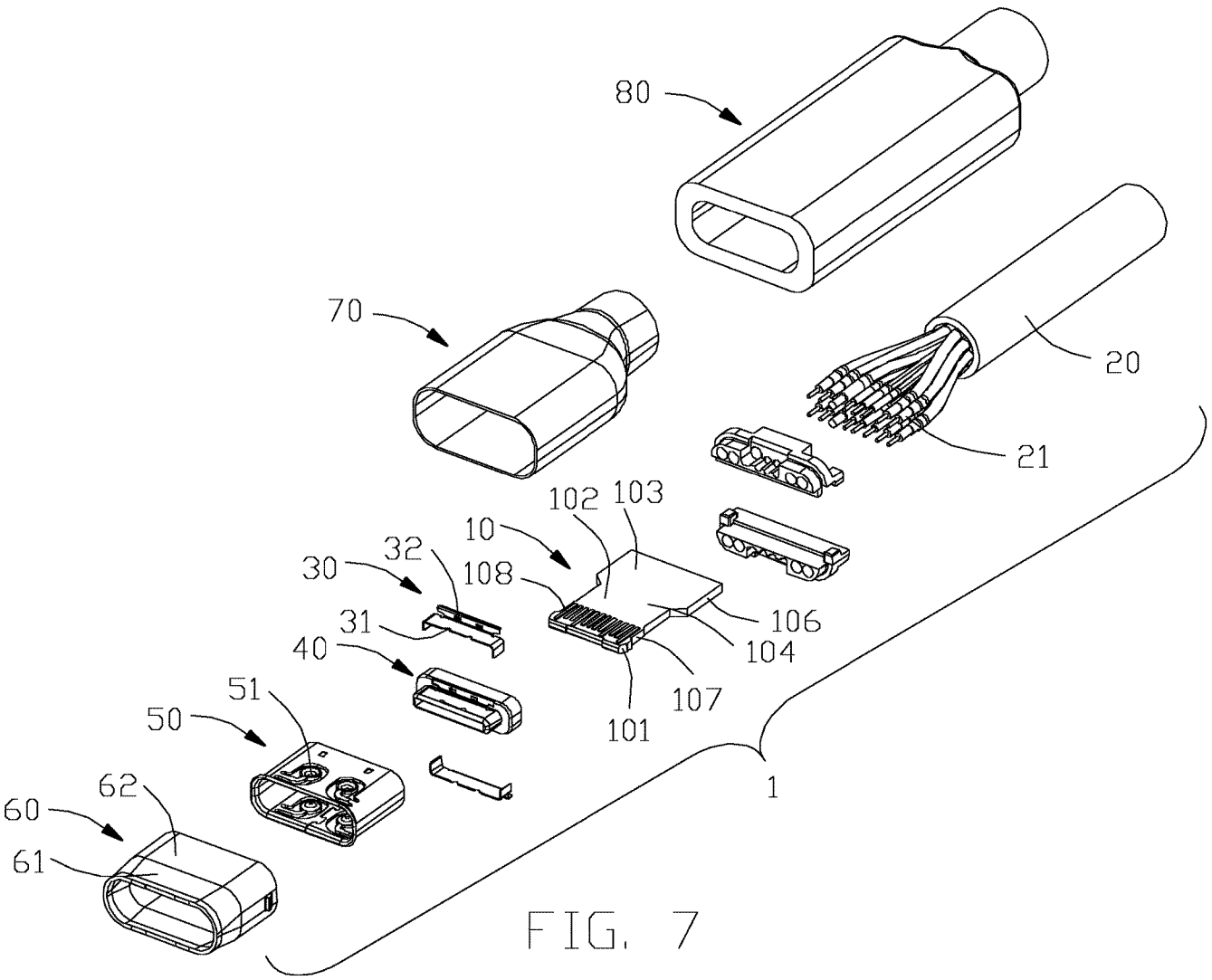
FIG. 7 is a further partially exploded view of the cable connector assembly in FIG. 5.
Figure 8:
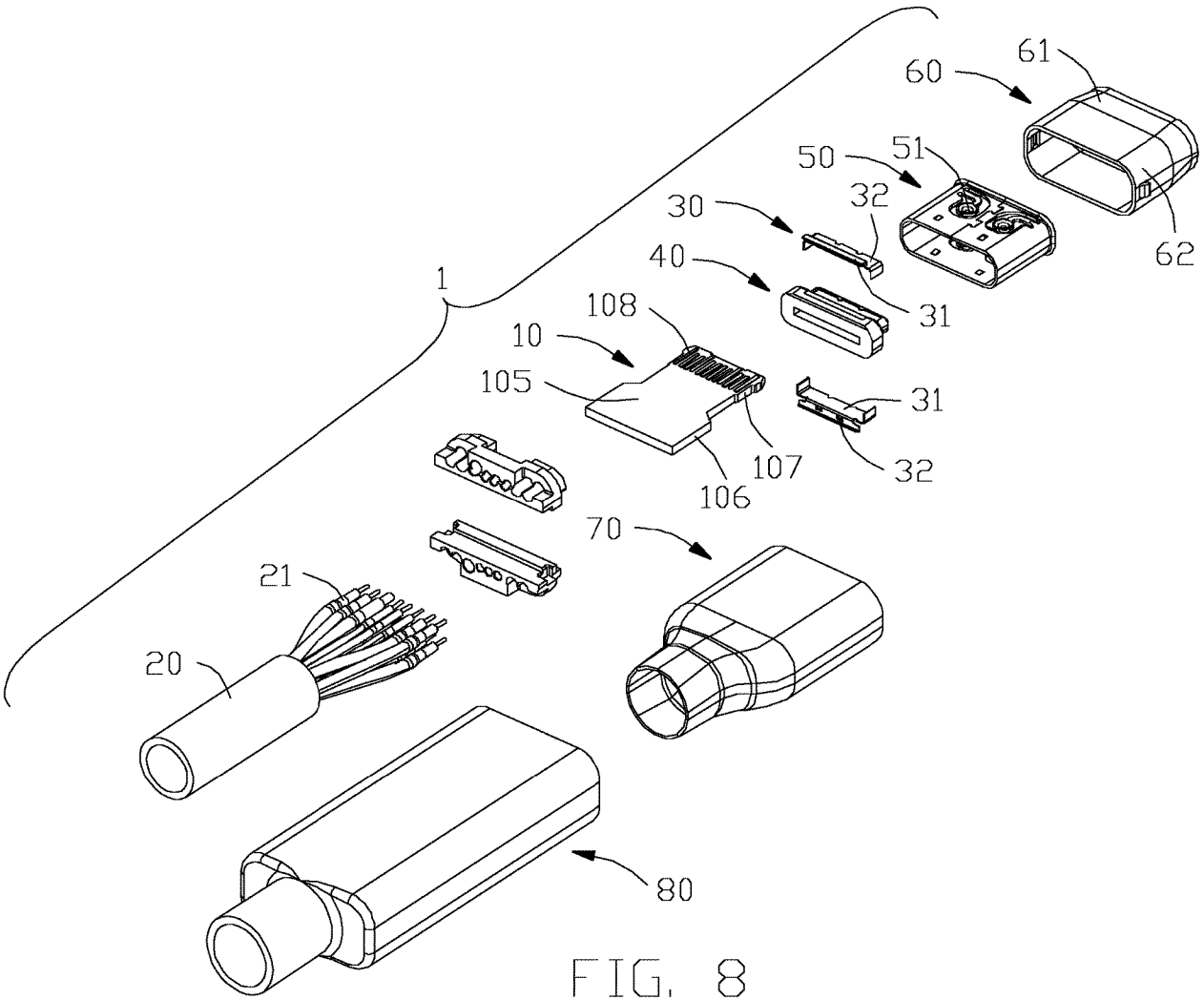
FIG. 8 is a view similar to FIG. 7 but from a different perspective.

Referring to FIGS. 1 to 9, a cable connector assembly 1, which is adapted to be mated with the plug connector as shown in US Pub. No. 20150288107 disclosed in the Information Disclosure Statement, in accordance with the present invention comprises a PCB 10, a cable 20 electrically connected to the PCB 10, an inner metal member 30 disposed about the PCB 10, an insulating member 40 holding the inner metal member 30 in position relative to the PCB 10, a metallic shield 50 around the insulating member 40, a front metal casing 60 surrounding the metallic shield 50, a rear metal casing 70 surrounding a front of the cable 20 and secured to the front metal casing 60, and an outer over-mold 80 surrounding the front and rear metal casings 60 and 70. The cable connector assembly 1 is provided with a space 100 inside the metallic shield 50 for insertion of a mating connector to connect with the PCB 10. Notably this connector is equipped with the so-called USB type C interface, so the cable connector assembly is reversible to be able to mate in two orientations.

The PCB 10 includes a front end 101 exposed in the space 100 for mating with the mating connector, a rear end 103 for connecting to the cable 20, and an intermediate portion 102 between the front end 101 and the rear end 103 wherein a tip of the front end 101 is adjacent to a front opening (not labeled) of the space 100. The width of the front end 101 is larger than the width of the intermediate portion 102 but is less than the width of the rear end 103. The circuit board 10 includes an upper surface 104, a lower surface 105, and a pair of side surfaces 106. The side surface 106 is provided with a conductive/grounding pad 107 which is electrically connected to a grounding layer of the printed circuit board 10. Each of the upper and lower surfaces 104 and 105 has a plurality of conductive pads 108. In this embodiment, the lateral side edges of the PCB 10 is directly formed with the locking structure (not labeled) around the conductive pads 107 for engagement with the pair of metal side latches 133 of the aforementioned U.S. Pub. No. 20150288107 wherein such a metal side latch 133 is mechanically and electrically connected to the conductive pad 107 during mating.

The cable 20 includes a number of wires 21 arranged in two rows, via assistance of a wire organizer (not labeled) behind the PCB 10, on the upper and lower surfaces 104 and 105 of the PCB 10, respectively. The cable 20 establishes electrical connection with a mating connector through the PCB 10.

As shown in FIGS. 5-9, the inner metal member 30 to be grounded for EMI shielding purpose is constructed of two pieces each including a front portion 31 surrounding the PCB 10 and a rear portion 32. The inner metal member 30 may also be a one-piece construction. The inner metal member 30 is provided at the intermediate portion 102 of the PCB 10. Notably, during mating, the inner metal member 30 is mechanically and electrically connected to the grounding member 16 of the aforementioned U.S. Pub. No. 20150288107. The insulating member 40 is molded with the PCB 10 to hold the metal member 30 and the PCB 10 together.

As shown in FIGS. 2-9, the metallic shield 50 is a through construction having a front, uninterrupted flared flange and enclosing the inner metal member 30. The shield 50 has a pair of upper spring arms 51 and a pair of lower spring arms 51 for engaging a mating connector to increase retention force. The spring arms 51 are generally symmetrically arranged.

The front metal casing 60 is preferably formed by metal drawing process to have an uninterrupted structure. The front metal casing 60 has a front portion 61 for engaging the metallic shield 50 and a rear portion 62 of a larger radial dimension than the front portion 61 for adapting to the spring arms 51 of the shield 50.

The rear metal casing 70 is also preferably formed by metal drawing process to have an uninterrupted structure. A front of the metal casing 70 engages a rear of the metal casing 60. A rear of the metal casing 70 encloses the cable 20. After the rear end of the metal sleeve housing 70 provided on the cable 20. The over-mold 80 is molded outside the front and rear metal casings 60 and 70.

Figure 9:
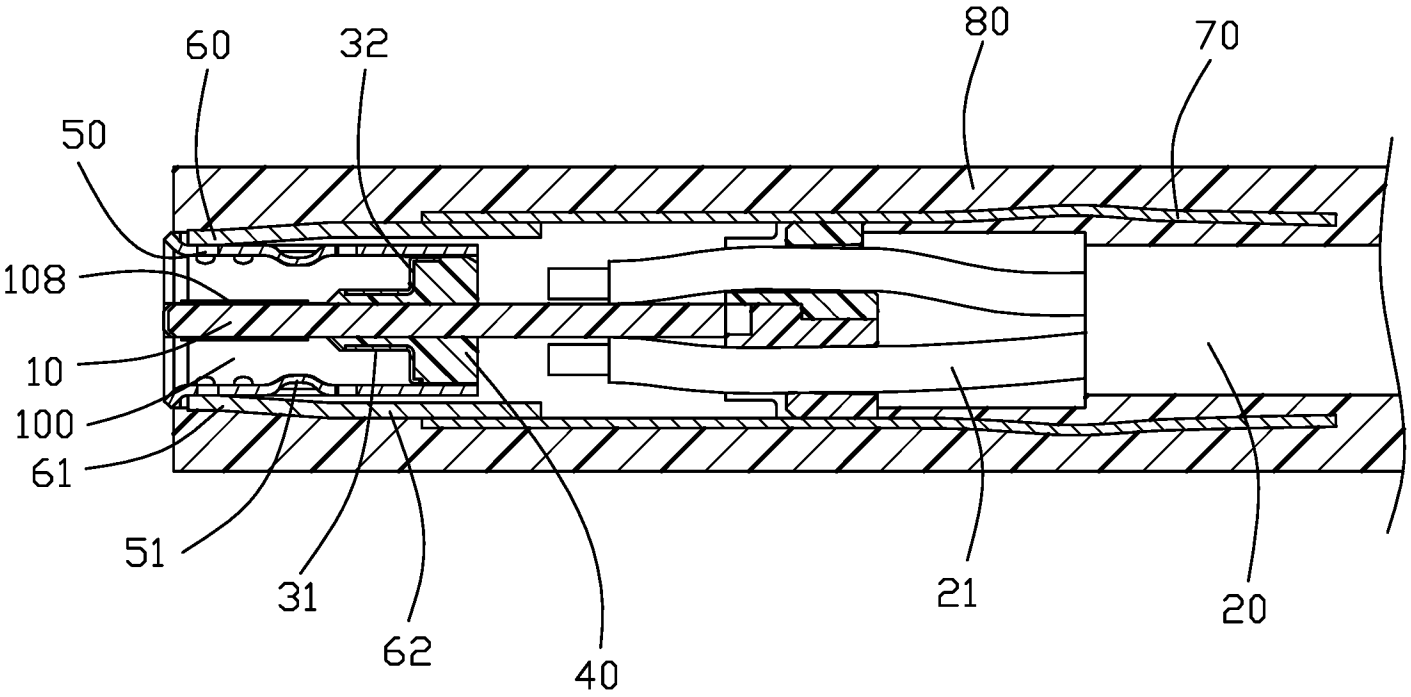
FIG. 9 is a cross-sectional view taken along line A-A in FIG. 1.

Notably, in the instant invention the printed circuit board 10 functions as a mating tongue 54 of U.S. Pub. No. 20150229077 as shown in the Information Disclosure Statement, to be mated with a plug connector and inherently includes at the middle level, a grounding layer (not shown) functioning as the shielding plate 76 of the mating tongue 54 of the aforementioned U.S. Pub. No. 20150229077. Notably, the typical type C receptacle connector disclosed in the aforementioned U.S. Pub. No. 20150229077 is mounted to the mother board while the instant invention is to connect to the cable. On the other hand, instead of directly forming the locking structure on two opposite side edges of the printed circuit board 10, an insulative frame (not shown) alternately may be provided upon the front edge and two opposite side edges of the PCB 10 to protect the PCB 10. In the disclosed embodiment, as shown in FIG. 9, the front end/edge of the over-mold 80 is close to the front end/edge of the metallic shield 50, and the front metal casing 60 extends rearward beyond a rear end of the metallic shield 50 and covers the spring arms 51 so that the over-mold 80 will not enter the space 100 via gaps around the spring arms 51 during molding.

What is claimed is:

1. A cable connector assembly comprising: a printed circuit board (PCB) having a front end for mating with a plug connector, a rear end, and an intermediate portion; a cable electrically connected to the rear end of the PCB; an inner metal member disposed about the intermediate portion of the PCB; an insulating member holding the inner metal member in position relative to the PCB; a metallic shield disposed around the insulating member; a front metal casing engaging the metallic shield; a rear metal casing surrounding a front of the cable and engaging the front metal casing; and an outer over-mold surrounding the front and rear metal casings; wherein said metallic shield forms a space in which the front end is exposed for mating with the plug connector; wherein the metallic shield has a plurality of spring arms for engaging a mating connector to increase retention force.

2. The assembly as claimed in claim 1, wherein the front metal casing has a front portion engaging the metallic shield and a rear portion adapted to the spring arms of the metallic shield.

3. The assembly as claimed in claim 1, wherein the insulating member is molded with the PCB and the inner metal member.

4. An electrical cable connector assembly comprising: a printed circuit board defining opposite front region, rear region and an intermediate region therebetween along a front-to-back direction; a plurality of conductive pads formed on the front region for mating with a plug connector; a cable including a plurality of wires mechanically and electrically connected to the rear region; an insulating member mounted upon the intermediate region; an inner metal member positioned upon the insulating member for grounding; and a metallic shield enclosing the front region including the conductive pads and the intermediate region including the inner metal member and the insulating member; wherein said metallic shield forms a space in which the front region is exposed for mating with the plug connector; wherein said metallic shield forms a plurality of spring arms extending into said space in which said front region extends.

5. The electrical cable connector assembly as claimed in claim 4, wherein two opposite lateral side edges around the front region are equipped with latching structures for locking with corresponding side latches of a plug connector adapted to be mated therewith.

6. The electrical cable connector assembly as claimed in claim 5, wherein said two opposite lateral side edges are equipped with grounding pads, respectively.

7. The electrical cable connector assembly as claimed in claim 4, wherein said insulating member fully surrounds the intermediate region via an injection process.

8. The electrical cable connector assembly as claimed in claim 7, wherein said inner metal member is integrally formed and embedded within the insulating member while exposing contacting surface toward the metallic shield.

9. The electrical cable connector assembly as claimed in claim 4, wherein a rear metallic shell encloses the rear region and the wires, and an overmold covers the rear metallic shell.

10. The electrical cable connector assembly as claimed in claim 4, further including a front metallic shell enclosing the metallic shield.

11. The electrical cable connector assembly as claimed in claim 4, wherein said inner metal member is mechanically and electrically connected to the metallic shield.

12. The electrical cable connector assembly as claimed in claim 10, wherein the said metallic shield forms a plurality of spring arms extending into said space, and said front metallic shell covers said spring arms, and an outer over-mold encloses said front metallic shell.

13. The electrical cable connector assembly as claimed in claim 12, wherein a front end of said over-mold is close to a front edge of the metallic shield.

14. An electrical cable connector assembly comprising: a printed circuit board defining opposite front region, rear region and an intermediate region therebetween along a front-to-back direction; a plurality of conductive pads formed on the front region for mating with a plug connector; a cable including a plurality of wires mechanically and electrically connected to the rear region; and a metallic shield defining a space, in which the front region including the conductive pads is exposed for mating with the plug connector; wherein each of two opposite lateral side edges of the front region is equipped with a latching structure having grounding means thereon for electrically and mechanically connecting with a side latch of a plug connector adapted to be mated within the space of the metallic shield; wherein said metallic shield forms a plurality of spring arms extending into said space in which said front region extends.

15. The electrical cable connector assembly as claimed in claim 14, wherein said latching structure is directly formed unitarily on the printed circuit board.

16. The electrical cable connector assembly as claimed in claim 14, further including an inner metal member located around the intermediate region and mechanically and electrically contacting the metallic shield.

17. The electrical cable connector assembly as claimed in claim 14, further including an outer over-mold enclosing the metallic shield, wherein a front end of the outer over-mold is close to a front edge of the metallic shield.

* * * * *